US005538683A

United States Patent [19]

Pinnow et al.

[11] Patent Number: 5,538,683

[45] Date of Patent: Jul. 23, 1996

[54] TITANIUM-FREE, NICKEL-CONTAINING MARAGING STEEL DIE BLOCK ARTICLE AND METHOD OF MANUFACTURE

[75] Inventors: Kenneth E. Pinnow; Carl J. Dorsch, both of Pittsburgh, Pa.

[73] Assignee: Crucible Materials Corporation, Syracuse, N.Y.

[21] Appl. No.: 162,660

[22] Filed: Dec. 7, 1993

[51] Int. Cl.[6] ..... B22F 3/24

[52] U.S. Cl. ..... 419/49; 419/28; 419/42; 419/53; 419/55

[58] Field of Search ..... 75/124, 208 R; 148/11.5; 419/28, 42, 53, 55, 49

[56] References Cited

U.S. PATENT DOCUMENTS

| | | | |
|---|---|---|---|
| 1,731,255 | 10/1929 | Marden et al. . | |
| 3,753,704 | 8/1973 | Manilla et al. | 75/208 R |
| 4,011,108 | 3/1977 | Hellman et al. | 148/11.5 |
| 4,013,458 | 3/1977 | Floreen | 75/124 |
| 4,710,345 | 12/1987 | Doi et al. | 419/28 |
| 5,015,539 | 5/1991 | Daxelmüller et al. | 428/685 |
| 5,091,264 | 2/1992 | Daxelmüller et al. | 428/685 |
| 5,393,488 | 2/1995 | Rhoads et al. | 420/95 |

FOREIGN PATENT DOCUMENTS 223763A 4/1990 United Kingdom .

OTHER PUBLICATIONS

Van Swam et al., "Properties of Maraging Steel 300 Produced by Powder Metallurgy," Powder Metallurgy, vol. 17, No. 33, 1974, pp. 33–45.

German, "The Critical Role of Titanium in Hot Isostatically Pressed Maraging Steels".

Liimatainen et al., "New Die Steel Reduces Tooling Costs in Aluminum Die Casting," Die Casting Engineer, Mar./Apr. 1991, pp. 34–40.

Brandis et al., "A New Maraging Hot Work Tool Steel," Thyssen Edelst. Techn. Ber., 1983, pp. 71–81.

German et al., "Ductility in Hot Isostatically Pressed 250–Grade Maraging Steel", Metallurgical Transactions A, vol. 9A, Mar. 1978, pp. 405–412.

German et al., "Effect of Hot Isostatic Pressing Temperature on the Properties of Inert Gas Atomized Maraging Steel," Materials Science and Engineering, 36 (1978) 223–230.

Smugeresky et al., "Hot Isostatic Pressing of Maraging Steels," Prog. in Powder Metallurgy, NPM 1, 1979, pp. 69–82.

Komatsubara et al. "Microstructures and mechanical properties of HIP consolidated 18% Ni maraging steel," Powder Metallurgy, vol. 30, No. 2, pp. 119–124, 1987.

Dissertation Abstracts International, vol. 52, No. 4, Number BRD–95062, Oct., 1991.

Kim et al., "Structures and Properties of a Rapidly Solidified Fe–19.1Ni–1.76Mn–0.73Ti Maraging Alloy," Materials Characterization, vol. 31, pp. 99–105, 1993.

*Primary Examiner*—Donald P. Walsh
*Assistant Examiner*—John N. Greaves
*Attorney, Agent, or Firm*—Finnegan, Henderson, Farabow, Garrett & Dunner

[57] ABSTRACT

A powder-metallurgy-produced, essentially titanium-free, nickel-containing maraging steel article such as for use in the manufacture of die casting die components and other hot work tooling components. The article preferably contains an intentional addition of niobium. The article may be produced as a hot-isostatically-compacted, solution annealed, fully dense mass of prealloyed particles, or alternately, as a hot-isostatically-compacted, plastically deformed and solution annealed, fully dense mass of prealloyed particles.

10 Claims, 4 Drawing Sheets

Die Block 92-71
1000X

Die Block 92-33
1000X

Die Block 92-34
1000X

A: PM, Ti-FREE, 0.08%Nb, MARAGING STEEL DIE BLOCK
B: PM, Ti-FREE, 0.18%Nb, MARAGING STEEL DIE BLOCK
C: PM, Ti-FREE, MARAGING STEEL DIE BLOCK
D: PM, Ti-BEARING, MARAGING STEEL DIE BLOCK
E: CONVENTIONAL Ti-BEARING, MARAGING STEEL DIE BLOCK

TITANIUM-FREE, NICKEL-CONTAINING MARAGING STEEL DIE BLOCK ARTICLE AND METHOD OF MANUFACTURE

BACKGROUND OF THE INVENTION

1. Field of the Invention

The invention relates to a powder-metallurgy-produced, essentially titanium-free, nickel-containing maraging steel die block article with especially good properties for metal die casting dies and other hot work tooling components and to a method for producing the same.

2. Discussion of the Prior Art

Dies used for die casting alloys of aluminum, magnesium, and other metals require steels that have good strength and toughness at ambient and elevated temperatures and high resistance to thermal fatigue. They also require steels that can be readily machined and that can be heat treated after machining with minimum difficulty and distortion. Currently, most die casting die components and other hot work tooling components are machined from die blocks that are cut from hot worked slabs or forgings.

The high-nickel, titanium-bearing maraging steels are excellent materials for use in die casting applications as all of the machining may be performed on the die blocks prior to age hardening. In addition, these steels in the age-hardened condition exhibit high strength in combination with high impact toughness and good thermal fatigue resistance, which promote long service life. Current high-nickel, titanium-bearing maraging steels have a serious drawback, however, in that their solidification characteristics result in significant segregation of the alloying elements during casting. This segregation can be detrimental to the properties of the steel, and especially to thermal fatigue resistance. In addition, this segregation inhibits the potential use of these steels in die casting dies that are cast to near-net-shape. When produced in ingot form, the high-nickel, titanium-bearing maraging steels are typically vacuum arc remelted to minimize segregation in the final product. This substantially increases the cost of the articles made from them.

Attempts have been made to minimize the segregation problems in high-nickel, titanium-bearing maraging steels by processing them by hot isostatic compaction of elemental or prealloyed powders made by conventional practices such as rotating electrode or argon gas atomization. However, the ductility and impact toughness of the as-compacted, powder-metallurgy-produced materials have generally been less than the ductility and impact toughness of conventionally-produced, ingot-cast material in the wrought condition. This appears to result from the segregation of the titanium and the formation of titanium-rich carbides and other compounds at the powder particle boundaries of the consolidated article made from the powder. It has been determined that hot plastic deformation can improve the impact toughness and tensile ductility of the high-nickel, titanium-bearing, powder-metallurgy-produced maraging steels to levels approaching those of conventionally-produced materials. However, the presence of the titanium-rich compounds in these materials still adversely affects their machinability. Furthermore, the amount of hot work needed to improve their properties is difficult to achieve at the center of large dies or die blocks where the extent of hot deformation is typically lower and less uniform than in other areas of the cross section. Thus, up to now there appear to be no fully practical methods for the powder metallurgy production of high-nickel maraging steels for die casting die blocks and related articles.

In work on the development of improved die casting die steels and articles made therefrom in accordance with the invention, it has been discovered that a more economical nickel-containing maraging steel with substantially better properties for metal die casting applications can be produced by gas atomization and hot isostatic compaction of essentially titanium-free, nickel-containing maraging steel powders. The prior art indicates that the elimination of titanium from nickel-containing maraging steels would significantly degrade their strength and age-hardening response. However, contrary to these prior art teachings the essentially titanium-free, nickel-containing maraging steel produced in accordance with this invention has unexpectedly good properties, and exhibits tensile properties, hardening response during aging, and thermal fatigue resistance which are substantially superior to those of conventionally-produced, titanium-bearing, nickel-containing maraging steels and articles made therefrom. In addition, the essentially titanium-free, nickel-containing maraging steel article produced in accordance with this invention exhibits substantially better machinability in combination with the above-mentioned properties than conventionally-produced, titanium-bearing, nickel-containing maraging steel articles. Also, it has been discovered that by adding a controlled amount of niobium to the powder-metallurgy-produced, essentially titanium-free, nickel-containing maraging steel article of the invention, a further substantial improvement in thermal fatigue resistance can be obtained without a loss in mechanical properties.

OBJECTS OF THE INVENTION

It is a primary object of the present invention to provide an essentially titanium-free, nickel-containing maraging steel die block article especially adapted for manufacture by powder metallurgy methods involving gas atomization and hot isostatic compaction of prealloyed powder, and that provides better tensile properties, response to age hardening and resistance to thermal fatigue than articles, including die blocks, made from conventionally-produced, titanium-bearing, nickel-containing maraging steels.

A more specific object of the invention is to provide a powder-metallurgy produced, essentially titanium-free, nickel-containing maraging steel die block article especially adapted for manufacture by powder metallurgy methods involving nitrogen gas atomization and hot isostatic compaction of prealloyed powder, and that provides a superior combination of tensile properties, aging response, machinability, and thermal fatigue resistance than conventionally-produced, or conventional powder-metallurgy-produced, titanium-bearing, nickel-containing maraging steel articles, such as die blocks. The preferred powder-metallurgy-produced nickel-containing maraging steel article of the invention is essentially titanium-free and contains an intentional addition of niobium to further improve thermal fatigue resistance.

Another related object of the invention is to provide a method for producing an essentially titanium-free, nickel-containing maraging steel article with an improved combination of tensile properties, aging response, machinability, and thermal fatigue resistance by gas atomization, hot isostatic compaction, hot plastic deformation, and heat treatment of prealloyed powder.

SUMMARY OF THE INVENTION

In accordance with the invention, there is provided a powder-metallurgy-produced, titanium-free, nickel-containing maraging steel article, such as a die block, that is adapted for use in the manufacture of die casting die components and other hot work tooling components. The article is a fully dense, consolidated mass of prealloyed particles which consist essentially of, in weight percent, up to 0.02 or 0.01 carbon, 10 to 23 nickel preferably 10 to 15 and 16 to 23 nickel, 7 to 20 or 7 to 12 cobalt, up to 10 or 8 molybdenum, up to 2.5 aluminum, up to 0.003 boron, up to 0.05 or up to 0.03 nitrogen, balance iron and incidental impurities. Preferably, the prealloyed particles comprise the chemical composition described above with an intentional addition of 0.05 to 0.5, or 0.05 to 0.25, or 0.15 to 0.25, or 0.15 to 0.19 weight percent niobium.

The article may contain niobium carbides with a maximum size of 3 microns, preferably in the longest dimension thereof.

In accordance with one embodiment of the invention, the article may be cut or machined from a hot-isostatically-compacted and solution-annealed compact of prealloyed powder, with the powder being produced by gas atomization and the compact produced by hot-isostatic compaction. In an alternate embodiment, the article may be cut from a hot-isostatically-compacted, hot plastically deformed and solution-annealed slab, billet or bar produced by hot-isostatic compaction of gas atomized powder. In a still further embodiment, the article may be forged to shape from a compact produced by hot isostatic compaction of prealloyed, gas atomized powder.

The prealloyed particles may be produced by gas atomization of the desired composition within the limits of the invention as defined herein. By the use of gas atomization, spherical particles of a character preferred for use in the practice of the invention are achieved. Nitrogen is the preferred atomizing gas.

In accordance with a preferred embodiment of the invention, the molten steel of a composition suitable for use in the practice of the invention is nitrogen gas atomized to produce prealloyed powder. The powder is loaded into low-carbon steel containers which are hot outgassed and then sealed by welding. The filled containers are compacted to full density by hot isostatic compaction for up to 12 hours within a temperature range of 1800° to 2400° F., and at a pressure in excess of 10000 psi. The compacts are solution annealed by heating to a temperature in excess of 1500° F., holding at said temperature for about ½-hour per inch of maximum thickness and for a minimum of three hours, and cooling to ambient temperature at a rate at least equal to that achieved in still air. Remnants of the low-carbon steel container are removed by machining or pickling, and then die blocks of the desired size and shape are cut from the compact. Alternately, and prior to solution annealing, the compacts may be hot worked by forging, rolling, or extrusion at a temperature within the range of 1400° F. to 2300° F. to form a die block or slab from which a die block may be cut.

By virtue of the method of manufacture in accordance with the invention, nickel-containing maraging steel die blocks can be made without titanium, and still exhibit tensile properties, hardness, ductility, and thermal fatigue resistance that are superior to those of conventionally-produced, titanium-bearing, nickel-containing maraging steel articles, such as die blocks. An article produced in accordance with the invention is characterized by the absence of titanium-carbides or other titanium-containing secondary phases at the prior powder particle boundaries in its microstructure. An article having the niobium-containing composition is characterized by a dispersion of niobium carbides which are uniformly distributed throughout the article, as opposed to being at the prior particle boundaries as is the case with articles produced from conventional titanium-containing alloys.

Although the invention has utility with articles having nickel contents of 10 to 23%, limited nickel contents of 10 to 15% would result in articles more suitable for use in high temperature applications. Nickel contents of 16 to 23% provide desirable combinations of properties for some lower-temperature applications.

DETAILED DESCRIPTION OF THE PREFERRED EMBODIMENTS

Figure 1A:
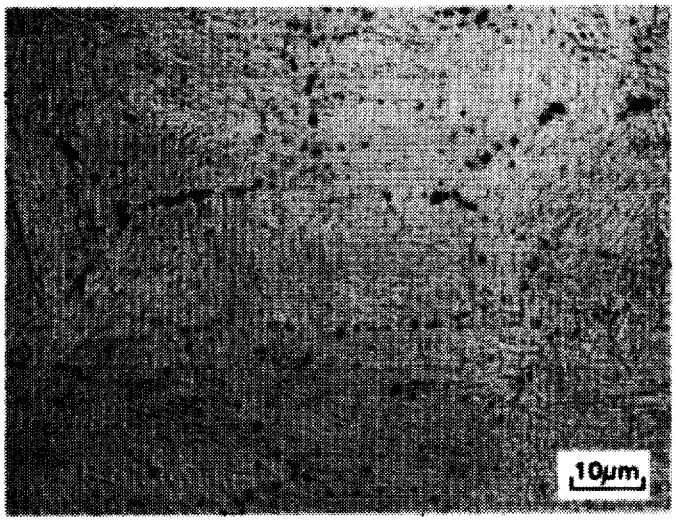
FIGS. 1*a*, 1*b*, and 1*c* are photomicrographs at a magnification of 1000X showing the microstructures of a powder-metallurgy-produced (PM), titanium-bearing, nickel-containing maraging steel die block; the PM, titanium-free, nickel-containing maraging steel die block of the invention; and a PM, titanium-free, niobium-modified, nickel-containing maraging steel die block of the invention, respectively.

To demonstrate the principles of the invention, several laboratory heats were melted, nitrogen gas atomized, quenched in liquid nitrogen and hot forged to produce die blocks having the compositions set forth in Table I. Also shown in the table is the composition of a commercial, conventionally-produced, titanium-bearing, nickel-containing maraging steel die block against which the properties of the die blocks of the invention are compared in the laboratory tests.

TABLE I

CHEMICAL COMPOSITIONS OF THE PM MARAGING STEELS AND THE COMMERCIAL, CONVENTIONAL MARAGING STEEL

| Material | Die Block Number | Chemical Composition, Weight Percent | | | | | | | | | | | | |
|---|---|---|---|---|---|---|---|---|---|---|---|---|---|---|
| | | C | Mn | P | S | Si | Ni | Co | Mo | Cu | Ti | Nb | B | N |
| PM Maraging Steel, Titanium-Bearing | 92-71 | 0.003 | — | — | 0.003 | 0.09 | 17.95 | 11.34 | 5.07 | — | 0.20 | — | 0.003 | 0.011 |
| PM Maraging Steel, Titanium-Free | 92-33 | 0.001 | 0.02 | 0.004 | 0.002 | 0.02 | 17.40 | 10.60 | 4.89 | 0.02 | — | — | 0.001 | 0.002 |
| PM Maraging Steel, Titanium-Free 0.08 Nb-modified | 92-98 | 0.002 | 0.01 | 0.002 | 0.002 | 0.01 | 17.70 | 10.95 | 4.86 | 0.04 | — | 0.08 | 0.001 | 0.003 |
| PM Maraging Steel, Titanium-Free 0.18 Nb-modified | 92-34 | 0.002 | 0.02 | 0.002 | 0.003 | 0.02 | 17.63 | 11.11 | 4.95 | 0.02 | — | 0.18 | 0.003 | 0.002 |
| Commercial, Conventional Maraging Steel | 89-144 | 0.008 | 0.05 | 0.002 | 0.001 | 0.15 | 17.49 | 11.05 | 4.89 | 0.20 | 0.13 | — | 0.003 | 0.006 |

The experimental die blocks were made from vacuum-induction-melted laboratory heats which were nitrogen gas atomized to produce prealloyed powder. Powder from each heat was screened to a −16 mesh size (U.S. Standard) and was loaded into a 3-inch-diameter by 8-inch-long low-carbon steel container. Each container was hot outgassed and was sealed by welding. The compacts were hot isostatically pressed for 4 hours at 2165° F. and 14500 psi and were cooled to ambient temperature. The compacts were then forged at a temperature of 2100° F. to produce 3-inch-wide by 7/8-inch-thick die blocks. The forged die blocks were cooled to ambient temperature in still air and were then solution annealed by heating to 1550° F., holding at said temperature for four hours, and cooling to ambient temperature in still air.

Several evaluations and tests were conducted to compare the advantages of the die blocks of the invention with those of a commercial, conventionally produced, titanium-bearing, high-nickel maraging steel die block, and to demonstrate the significance of their composition and method of manufacture. Tests were conducted to illustrate the effects of composition and method of manufacture on microstructure, age-hardening response, tensile properties, impact toughness, machinability, and thermal fatigue resistance. Specimens for the various laboratory tests were cut from the experimental die blocks and from the commercial, conventional, titanium-bearing, high-nickel maraging steel die block. They were then age hardened, finish machined, and tested.

Figure 1B:
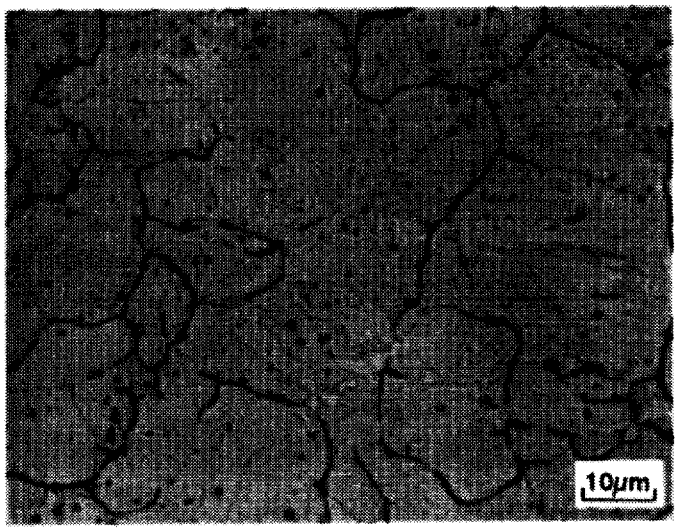
Figure 1C:
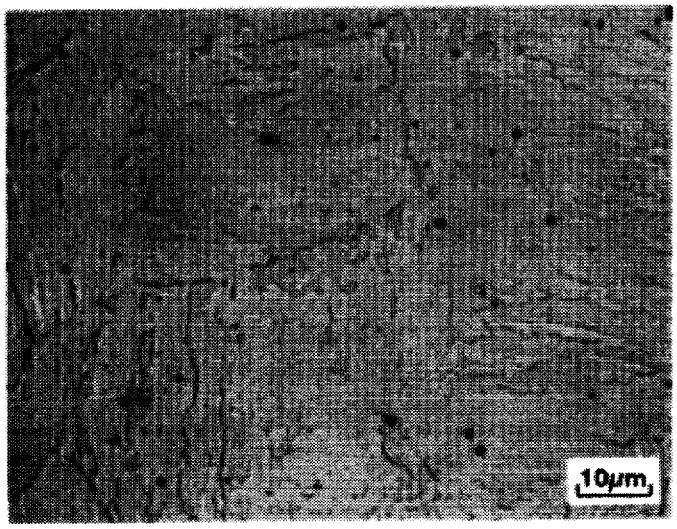

The microstructures of the experimental die blocks in the solution-annealed condition are presented in FIG. 1. FIG. 1*a* shows that when a typical, titanium-bearing, high-nickel maraging steel having a chemical composition outside the scope of the invention is atomized and formed into a die block using the method in accordance with the invention, small titanium-rich particles (carbides, nitrides, and/or oxides) form at the prior powder particle boundaries in the steel. FIG. 1*b* shows the microstructure of the die block of the invention which is titanium-free. As shown, there are no titanium-rich particles at the prior powder particle boundaries. FIG. 1*c* shows the microstructure of the die block of the invention which is titanium-free and which contains 0.18% niobium. Both die blocks of the invention contain oxide particles which are uniformly dispersed throughout the microstructure. These oxides are an inherent product of the method of atomization used in the laboratory. The microstructure in FIG. 1*c* also contains niobium carbide particles which result from the niobium addition to the steel. This figure shows that the niobium carbides are all less than 3 microns in the largest dimension, and that the niobium carbides and other second phase particles do not form at the prior powder particle boundaries in this die block.

Figure 2:
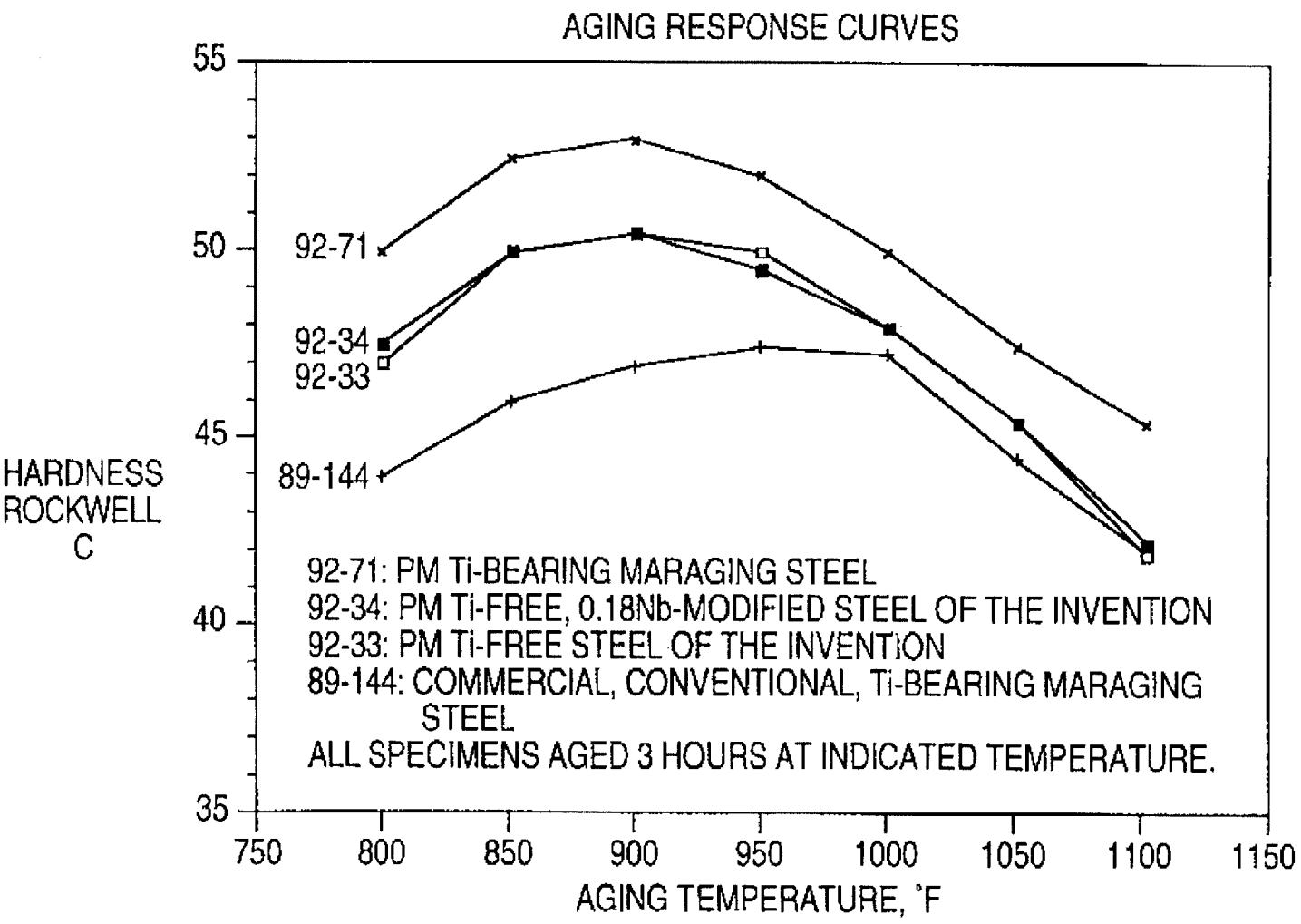
FIG. 2 is a graph showing the age-hardening responses of samples of a PM, titanium-bearing, nickel-containing maraging steel die block; the PM, titanium-free, nickel-containing maraging steel die block of the invention; a PM, titanium-free, niobium-modified, nickel-containing maraging steel die block of the invention; and a commercial, conventionally-produced, titanium-bearing, nickel-containing maraging steel die block.

To evaluate the age-hardening responses of the experimental die blocks and the commercial, conventional, titanium-bearing die block, specimens were cut from the solution-annealed die blocks and were age hardened by heating to one of six different aging temperatures, holding at the aging temperature for 3 hours, and air cooling to ambient temperature. The results of hardness measurements made on the specimens are presented in Table II and in FIG. 2.

TABLE II

AGING RESPONSES OF THE PM MARAGING STEELS AND THE COMMERCIAL, CONVENTIONAL MARAGING STEEL

| Maraging Die Block Steel | Hardness, HRC, After Indicated Hours at Aging Temperature | | | | | | | | | | | | | | | | |
|---|---|---|---|---|---|---|---|---|---|---|---|---|---|---|---|---|---|
| | | 800° F. | | | | 850° F. | | | | 900° F. | | | | 950° F. | | | |
| | SA[1] | 3 | 6 | 24 | 48 | 3 | 6 | 24 | 48 | 3 | 6 | 24 | 48 | 3 | 6 | 24 | 48 |
| Commercial, Conventional Steel | 28 | 44 | 46.5 | 50.5 | 51.5 | 46 | 47.5 | | 51 | 47 | 47 | 48.5 | 48.5 | 47.5 | 47.5 | | 46.5 |
| PM, titanium-bearing | 28 | 50 | 50.5 | 53.5 | 54.5 | 52.5 | 53 | | 53.5 | 53 | 53 | 52.5 | 51.5 | 52 | 51 | | 49 |

TABLE II-continued

AGING RESPONSES OF THE PM MARAGING STEELS AND THE COMMERCIAL, CONVENTIONAL MARAGING STEEL

| | | | | | | | | | | | | | | | | |
|---|---|---|---|---|---|---|---|---|---|---|---|---|---|---|---|---|
| PM, titanium-free | 29 | 47 | 49 | 51.5 | 51.5 | 50 | 50.5 | | 49.5 | 50.5 | 48 | 50.5 | 46.5 | 50 | 47 | 44.5 |
| PM, Ti-free 0.18 Nb-mod | 30 | 47.5 | 49 | 52 | 52.5 | 50 | 51 | | 52 | 50.5 | 51.5 | 50.5 | 48 | 49.5 | 49.3 | 46.5 |

| Maraging Die | Hardness, HRC, After Indicated Hours at Aging Temperature | | | | | | | | | | | |
|---|---|---|---|---|---|---|---|---|---|---|---|---|
| | 1000° F. | | | | 1050° F. | | | | 1100° F. | | | |
| Block Steel | 3 | 6 | 24 | 48 | 3 | 6 | 24 | 48 | 3 | 6 | 24 | 48 |
| Commercial, Conventional Steel | 47.3 | 46.5 | 46 | 44 | 44.5 | 43.5 | | 41.5 | 42.2 | 41.5 | 40.5 | 39.5 |
| PM, titanium-bearing | 50 | 49.5 | 48.5 | 46.5 | 47.5 | 46.5 | | 43.5 | 45.5 | 44.5 | 43 | 42 |
| PM, titanium-free | 48 | 45 | 46.5 | 42 | 45.5 | 44 | | 39.5 | 42 | 41 | 38.5 | 37 |
| PM, Ti-free, 0.18 Nb mod | 48 | 47.3 | 46 | 44 | 45.5 | 44.5 | | 41 | 42.3 | 41 | 39.5 | 39 |

[1]Solution-annealed hardness.

These results show that die blocks of the invention (Blocks 92-33 and 92-34) exhibit higher aged hardness than that of the commercial, conventional, titanium-bearing die block at essentially all of the aging temperatures in the hardening response survey.

The results of tension tests conducted on the experimental die blocks and on the commercial, conventional, titanium-bearing die block are presented in Table III. The specimens for these tests were age hardened by heating to 980° F., holding at temperature for 6 hours, and air cooling to ambient temperature. These results show that the die blocks of the invention (Blocks 92-33, 92-34, and 92-98) exhibit better tensile properties than those of the commercial, conventional, titanium-bearing die block.

TABLE III

TRANSVERSE TENSILE PROPERTIES

| Maraging Die Block Steel | Die Block Number | HRC | Tested at 72° F. YS (ksi) | TS (ksi) | EL (%) | RA (%) |
|---|---|---|---|---|---|---|
| Commercial, conventional, titanium-bearing | 89-144 | 48 | 205 | 215 | 7 | 16 |
| PM titanium-bearing | 92-93 | 50 | 222 | 242 | 14 | 41 |
| PM titanium-free | 92-33 | 46 | 200 | 221 | 15 | 45 |
| PM Ti-free, 0.18 Nb mod | 92-34 | 48 | 219 | 238 | 14 | 47 |
| PM Ti-free, 0.08 Nb mod | 92-98 | 46 | 200 | 221 | 14 | 42 |

The results of impact tests conducted at 72° F. on the experimental die blocks and on the commercial, conventional, titanium-bearing die block are presented in Table IV.

TABLE IV

CHARPY V-NOTCH IMACT TOUGHNESS

| Maraging Die Block Steel | Die Block Number | Hardness Rockwell C | Impact Toughness, ft-lb Test Values | Average |
|---|---|---|---|---|
| PM, titanium-bearing | 92-71 | 50 | 11, 12, 12 | 11.7 |
| PM, titanium-free | 92-33 | 46 | 17, 16, 17.5 | 16.8 |
| PM, Ti-free, | 92-34 | 48 | 17, 16.5, 16.5 | 16.7 |

TABLE IV-continued

CHARPY V-NOTCH IMACT TOUGHNESS

| Maraging Die Block Steel | Die Block Number | Hardness Rockwell C | Impact Toughness, ft-lb Test Values | Average |
|---|---|---|---|---|
| 0.18 Nb-mod PM, Ti-free, 0.08 Nb-mod | 92-98 | 46 | 17, 17, 18 | 17.3 |
| Commercial, conventional, titanium-bearing | 89-144 | 48 | 17, 18, 17 | 17.3 |

The specimens for these tests were age hardened by heating to 980° F., holding at temperature for 6 hours, and air cooling to ambient temperature. These test results show that the notch toughness of the titanium-free die blocks of the invention, as measured by the Charpy V-notch impact test, is clearly superior to that of a titanium-bearing die block (Block 92-71) whose composition is outside the scope of the invention, but which was made in accordance with the method of the invention. The die blocks of the invention exhibit notch toughness that is comparable to that of the commercial, conventional, titanium-bearing die block.

Figure 3:
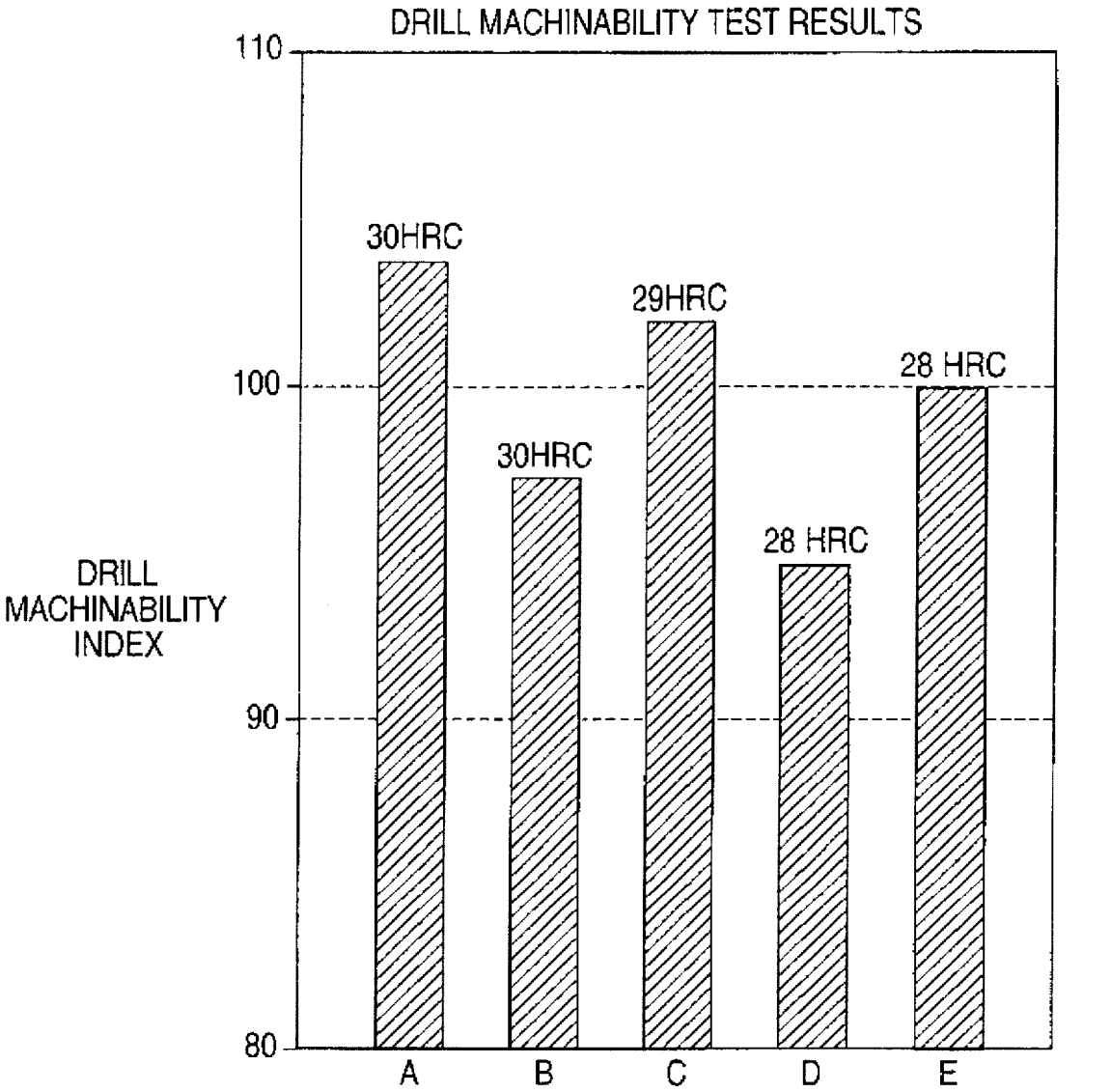
FIG. 3 is a graph showing the results of drill machinability tests on samples of a PM, titanium-bearing, nickel-containing maraging steel die block; the PM, titanium-free, nickel-containing maraging steel die block of the invention; the PM, titanium-free, niobium-modified, nickel-containing maraging steel die blocks of the invention; and a commercial, conventional, titanium-bearing, nickel-containing maraging steel die block.

The results of drill machinability tests conducted on the experimental die blocks and on the commercial, conventional, titanium-bearing die block are presented in Table V and in FIG. 3.

TABLE V

DRILL MACHINABILITY TEST RESULTS

| Maraging Die Block Steel | Hardness Rockwell C | Drill Machinability Index Test Values | Average |
|---|---|---|---|
| PM, Ti-bearing | 28 | 92, 94, 98 | 94.7 |
| PM, Ti-free | 29 | 94, 107, 105 | 102.0 |
| PM, Ti-free, 0.18 Nb-mod | 30 | 97, 98, 97 | 97.3 |
| PM, Ti-free, 0.08 Nb-mod | 30 | 100, 106, 105 | 103.7 |
| Commercial, conventional, titanium-bearing | 28 | test standard | 100.0 |

The machinability indexes given in this table and figure were obtained by comparing the times required to drill holes of the same size and depth in the experimental die blocks and in the commercial, conventional, titanium-bearing die block and by multiplying the ratios of these times by 100. Indexes greater than 100 indicate that the drill machinability of the die block of is greater than that of the commercial, conventional, titanium-bearing die block. These test results show that the drill machinabilities of the titanium-free die blocks of the invention are superior to that of a PM titanium-bearing die block having a composition outside the scope of the invention, but which was manufactured in accordance with the method of the invention.

Figure 4:
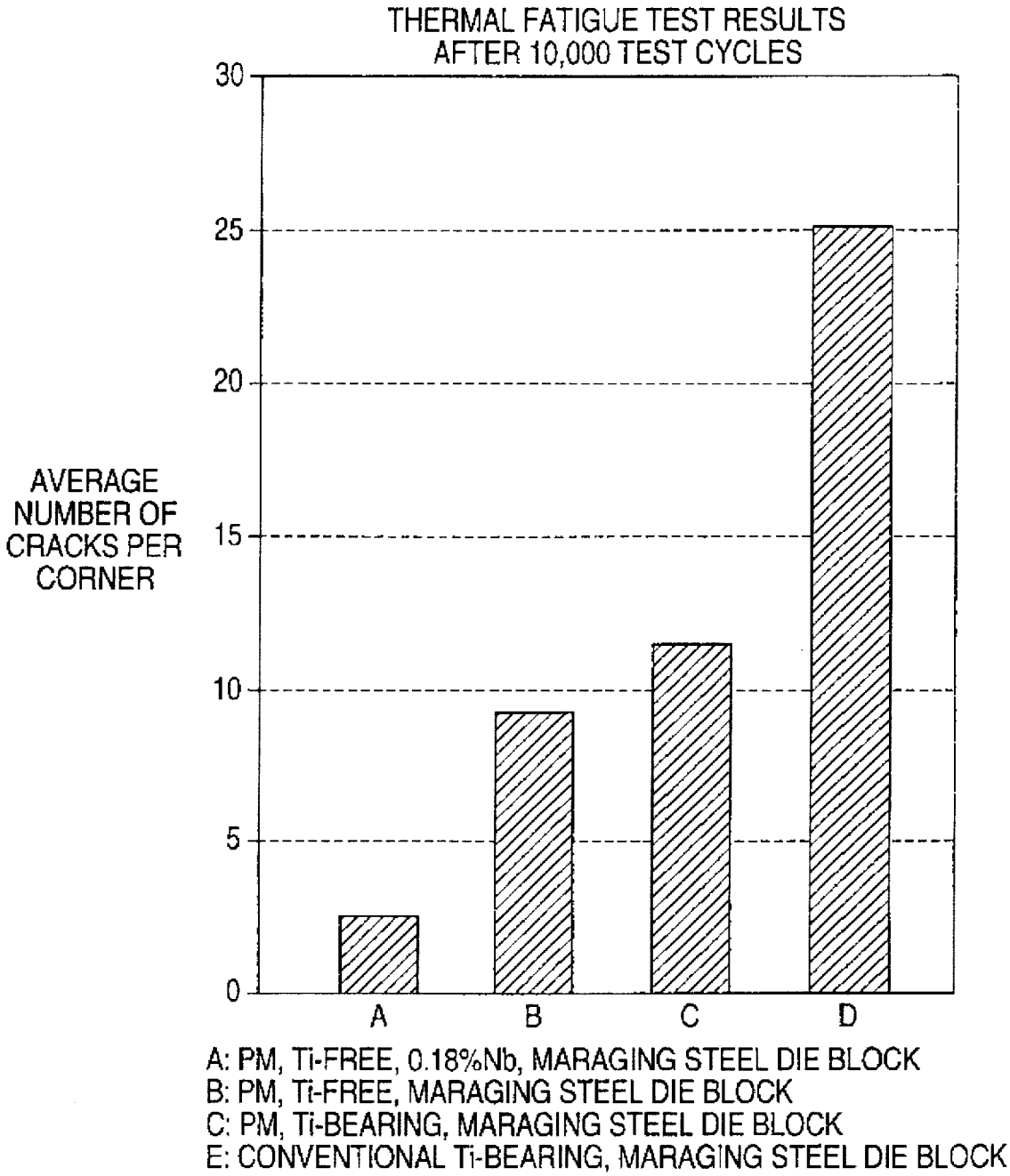
FIG. 4 is a graph showing the results of a thermal fatigue test on samples of a PM, titanium-bearing, nickel-containing maraging steel die block; the PM, titanium-free, nickel-containing maraging steel die block of the invention; a PM, titanium-free, niobium-modified, nickel-containing maraging steel die block of the invention; and a commercial, conventional, titanium-bearing, nickel-containing maraging steel die block.

The results of thermal fatigue tests conducted on the experimental die blocks and on the commercial, conventional, titanium-bearing die block are given in FIG. 4. This test is conducted by simultaneously immersing specimens alternately into a bath of molten aluminum maintained at 1250° F. and a water bath at approximately 200° F. After 10000 cycles, the specimens were removed and microscopically examined for the presence of thermal fatigue cracks which form along the corners of the rectangular cross sections of the specimens. Cracks in excess of 0.015 inch were counted, and a higher average numbers of cracks per corner indicates poorer resistance to thermal fatigue cracking. The cyclic nature of the test simulates the thermal cycling that die casting die components and other hot work tooling components experience as they are alternately heated by contact with hot work pieces and cooled by water or air cooling. The results in FIG. 4 clearly show the superior thermal fatigue resistance of the die blocks of the invention in contrast to that of the PM titanium-bearing die block whose composition is outside the scope of the invention, but which was made in accordance with the method of the invention, and the commercial, conventional, titanium-bearing die block.

The experimental results clearly demonstrate that a die block article with substantially improved thermal fatigue resistance can be produced by powder metallurgical methods involving nitrogen gas atomization and hot isostatic compaction of prealloyed, titanium-free, nickel-containing maraging steel powders. The method of the invention avoids the problems encountered in the powder metallurgy production of existing titanium-bearing, high-nickel maraging steels and makes practical the production of nickel-containing maraging steel die blocks with an improved combination of aging response, much inability, and thermal fatigue resistance heretofore unobtainable by either powder metallurgy or conventional production by ingot casting of existing nickel-containing titanium-bearing maraging steels.

All percentages are in weight percent unless otherwise noted.

Maraging steels as described herein are defined as low-carbon martensitic steels that are strengthened during aging heat treatment by the precipitation of intermetallic compounds.

As used herein, the term "essentially titanium-free" refers to nickel-containing maraging steels to which no intentional titanium additions have been made in their production, and/or wherein titanium is not present in an amount to result in titanium-containing secondary phases that materially affect the properties of the article.

What is claimed is:

1. A method for manufacturing an essentially titanium-free, nickel-containing maraging steel die block article adapted for use in the manufacture of die casting die components and other hot work tooling components, said article comprising a fully dense, consolidated mass of prealloyed particles consisting essentially of, in weight percent, up to 0.02 carbon, 10 to 23 nickel, 7 to 20 cobalt, up to 10 molybdenum, up to 2.5 aluminum, up to 0.003 boron, up to 0.05 nitrogen, balance iron and incidental impurities;

said method comprising producing said prealloyed particles by gas atomization and hot isostatic compacting the prealloyed particles to full density to form a compact, solution annealing said compact, and cutting said die block article from said solution-annealed compact.

2. The method of claim 1, wherein said article has up to 0.01 carbon, 7 to 12 cobalt, up to 8 molybdenum and up to 0.03 nitrogen.

3. A method for manufacturing an essentially titanium-free, nickel-containing maraging steel die block article adapted for use in the manufacture of die casting die components and other hot work tooling components, said article comprising a fully dense, consolidated mass of prealloyed particles consisting essentially of, in weight percent, up to 0.02 carbon, 10 to 23 nickel, 7 to 20 cobalt, up to 10 molybdenum, up to 2.5 aluminum, up to 0.003 boron, 0.05 to 0.5 niobium, up to 0.05 nitrogen, balance iron and incidental impurities;

said method comprising producing said prealloyed particles by gas atomization and hot isostatic compacting the prealloyed particles to full density to form a compact, solution annealing said compact, and cutting said die block article from said solution-annealed compact.

4. The method of claim 3, wherein said article has up to 0.01 carbon, 7 to 12 cobalt, up to 8 molybdenum and up to 0.03 nitrogen.

5. The method of claim 3 or 4, wherein said article has 0.05 to 0.25 niobium.

6. The method of claim 1 or 3 in which the hot-isostatically-compacted compact is subjected to hot plastic deformation prior to the solution annealing heat treatment.

7. The method of claim 1 or 3 in which the gas atomization is performed using nitrogen gas.

8. The method of claim 1 or 3 wherein said hot isostatic compaction is conducted for up to 12 hours within a temperature range of 1800° to 2400° F. and at a pressure in excess of 10,000 psi, and said solution annealing is conducted by heating to a temperature in excess of 1500° F., holding at said temperature for about ½-hour per inch of maximum thickness and for a minimum of 3 hours, and cooling to ambient temperature at a rate at least equal to that achieved in still air.

9. The method of claim 6 wherein the hot plastic deformation is performed within a temperature range of 1400° to 2300° F.

10. The method of claim 3 in which the maximum size of the niobium carbides is 3 microns.

* * * * *